US006561182B2

(12) United States Patent
Wong

(10) Patent No.: US 6,561,182 B2
(45) Date of Patent: May 13, 2003

(54) WATER HEATER, STEAM GENERATOR AND GAS BURNER THEREFOR

(76) Inventor: Tai Loi Wong, 1st Floor, New City Centre, 2 Lei Yue Mun Road, Kwun Tong, Kowloon, Hong Kong SAR (CN)

( * ) Notice: Subject to any disclaimer, the term of this patent is extended or adjusted under 35 U.S.C. 154(b) by 0 days.

(21) Appl. No.: 09/891,120

(22) Filed: Jun. 28, 2001

(65) Prior Publication Data

US 2002/0040710 A1 Apr. 11, 2002

(30) Foreign Application Priority Data

Jun. 28, 2000 (CN) ..... 00117220
Jun. 28, 2000 (CN) ..... 00228687 U

(51) Int. Cl.[7] ..... F24H 1/20; A47J 27/26

(52) U.S. Cl. ..... 126/360.1; 126/391.1; 126/99 D; 126/110 R

(58) Field of Search ..... 126/360.1, 391.1, 126/109, 99 D, 110 R; 99/403, 408; 431/354, 355

(56) References Cited

U.S. PATENT DOCUMENTS 2,594,063 A * 4/1952 Norman ..... 122/31.2
3,970,072 A * 7/1976 Chipchase ..... 126/391.1
4,771,762 A * 9/1988 Bridegum ..... 122/14.22
4,877,014 A * 10/1989 Beasley ..... 122/18.3
5,524,608 A 6/1996 Yeung et al.
5,992,301 A 11/1999 Mukumoto
6,106,276 A * 8/2000 Sams et al. ..... 126/110 C
6,192,880 B1 * 2/2001 Furuhashi ..... 126/357.1
6,379,146 B1 * 4/2002 Zink et al. ..... 110/262

FOREIGN PATENT DOCUMENTS

GB 2129543 A 5/1984
WO WO94/11850 8/1994

* cited by examiner

*Primary Examiner*—Henry Bennett
*Assistant Examiner*—Alfred Basichas
(74) *Attorney, Agent, or Firm*—Burns, Doane, Swecker & Mathis, L.L.P.

(57) ABSTRACT

A hot water boiler and/or hot steam generator as well as a gas burner and a water vessel for the hot water boiler and hot steam generator are disclosed. The water boiler or hot steam generator includes a water vessel which includes an elongated flue pipe which is preferably convoluted and which is fully submerged in the water to be heated during normal operations so that the generated heat is distributed along the flue pipe which is also the gas combustion chamber and can be efficiently dispersed into the water surrounding the flue pipe. This invention also describes a gas burner having an elongated body whose internal aperture increases along its length to create a venturi effect to improve combustion of the fuel gas mixture.

15 Claims, 8 Drawing Sheets

WATER HEATER, STEAM GENERATOR AND GAS BURNER THEREFOR

This application claims priority under 35 U.S.C. §§119 and/or 365 to 0117220.4 filed in China on Jun. 28, 2000; the entire content of which is hereby incorporated by reference.

FIELD OF THE INVENTION

The present invention relates to a hot steam generator and, more particularly, to a hot steam generating apparatus especially but not solely for use in steam cooking. The present invention also relates to a water boiler, a vessel for a water boiler and/or steam generator as well as a gas burner for a water boiler or hot steam generating apparatus.

BACKGROUND OF THE INVENTION

A continuous supply of hot steam is essential for the provision of many services in hotels, restaurants, hospitals and other public or private establishments. Hot steam supply for the afore-mentioned purposes is generally produced by boiling water under atmospheric pressure by directly heating a water vessel. Gas is probably one of the cleanest fluid and is therefore widely use for generating hot steam for the afore-mentioned purposes. In conventional hot steam generating apparatuses using gas burners, a gas burner is placed underneath the bottom of a water vessel. Water contained in the water vessel is heated by direct heating of the bottom of the water vessel by the flames and heat generated by fuel gas combustion. In a conventional burner, the flames are pushed by gas pressure towards the bottom of the water vessel and spread over the bottom surface of the vessel, thereby healing the bottom surface of the vessel. However, conventional gas water heaters of the afore-mentioned type are known to have very low thermal efficiency due to dissipation of the heat from the vessel into the atmosphere and also because the flame contact area only represents a small percentage of the gas combustion area. Typically, the thermal efficiency for conventional water heater or steam generator is below 40% for a large-size gas burner or for a heated water vessel with a flat vessel bottom. Also, the prolonged localized direct spot heating on the bottom of the vessel always causes localized damage to the vessel.

To improve the thermal efficiency of a water boiler or hot steam generator, it has been found in practice that, by arranging a gas burner at one side of the water vessel and the fuel gas outlet at the other side, the hot fuel gases from the burner tend to spread across the whole bottom of the water vessel and provides an even and efficient heating of the water vessel. In U.S. Pat. No. 5,524,608, it has been suggested to include flue pipes which extend across the water vessel and are submerged in the water being boiled for steam generation. Such a proposed arrangement, while providing improved thermal efficiency, is still not optimal for a large-size water boiler or steam generator. Hence, it will be desirable to provide an improved water heater and steam generator with improved thermal efficiency which is suitable for general purposes.

OBJECT OF THE INVENTION

It is therefore an object of the present invention to provide a water boiler or hot steam generator which alleviates the shortcomings of existing water boilers or hot steam generators with an aim to achieving high thermal efficiency and clean combustion, As reliability and low-maintenance costs are important for such applications, it is desirable that such apparatuses have relatively simple designs and can be manufactured at low costs. It is also an object of the present invention to provide an improved gas burner for use with such a water boiler or hot steam generator. It is at least an object of the present invention to provide the general public with alternative choices of water boilers, hot steam generators or gas burners which are simple and at the same time environmental friendly with improved thermal efficiency. Preferably such apparatus should also be provided with improved safety devices.

SUMMARY OF THE INVENTION

According to the present invention, there is provided a water boiler or hot steam generator including a gas burner and a water vessel having a peripheral wall, said water vessel includes a combustible gas inlet and an exhaust gas outlet disposed on said peripheral wall of said water vessel, said gas inlet and said gas outlet are interconnected by a flue pipe which is adapted to be fully submerged in the water inside the water vessel during normal operation, wherein combustion of the gas originating from said gas burner occurs almost entirely within said flue pipe and combustion occurs substantially along the length of said flue pipe.

According to a second aspect of the present invention, there is provided a water vessel for water boiling or hot steam generation including a peripheral wall, said water vessel includes a combustible gas inlet and an exhaust gas outlet disposed on said peripheral wall of said water vessel, said gas inlet and said gas outlet are interconnected by a flue pipe which is adapted to be fully submerged in the water inside the water vessel during normal operation, wherein a portion of the flue pipe adjacent to the gas inlet is elevated from the bottom of said water vessel so that, during operation, the space between that portion of said flue pipe and the bottom of said water vessel is filled with water.

Preferably, the path of said flue pipe is convoluted and preferably, said flue pipe includes at least an obtuse bend.

Preferably, the periphery of said flue pipe is surrounded by water in the water vessel during normal operations.

Preferably, an aperture means for abruptly changing the aperture of said flue pipe for a very short length is disposed at a short distance from said gas inlet.

According to a third aspect of the present invention, there is provided a gas burner having a flame outlet with an aperture which is partitioned into 3 parts, the relative area of said 3 parts are adjustable to provide a main flame outlet and secondary flame outlets.

BRIEF DESCRIPTION OF THE DRAWINGS

Preferred embodiments of the present invention will now be explained in further details by way of example and with reference to the accompanying drawings in which.

DETAILED DESCRIPTION OF THE PREFERRED EMBODIMENTS

Figure 1:
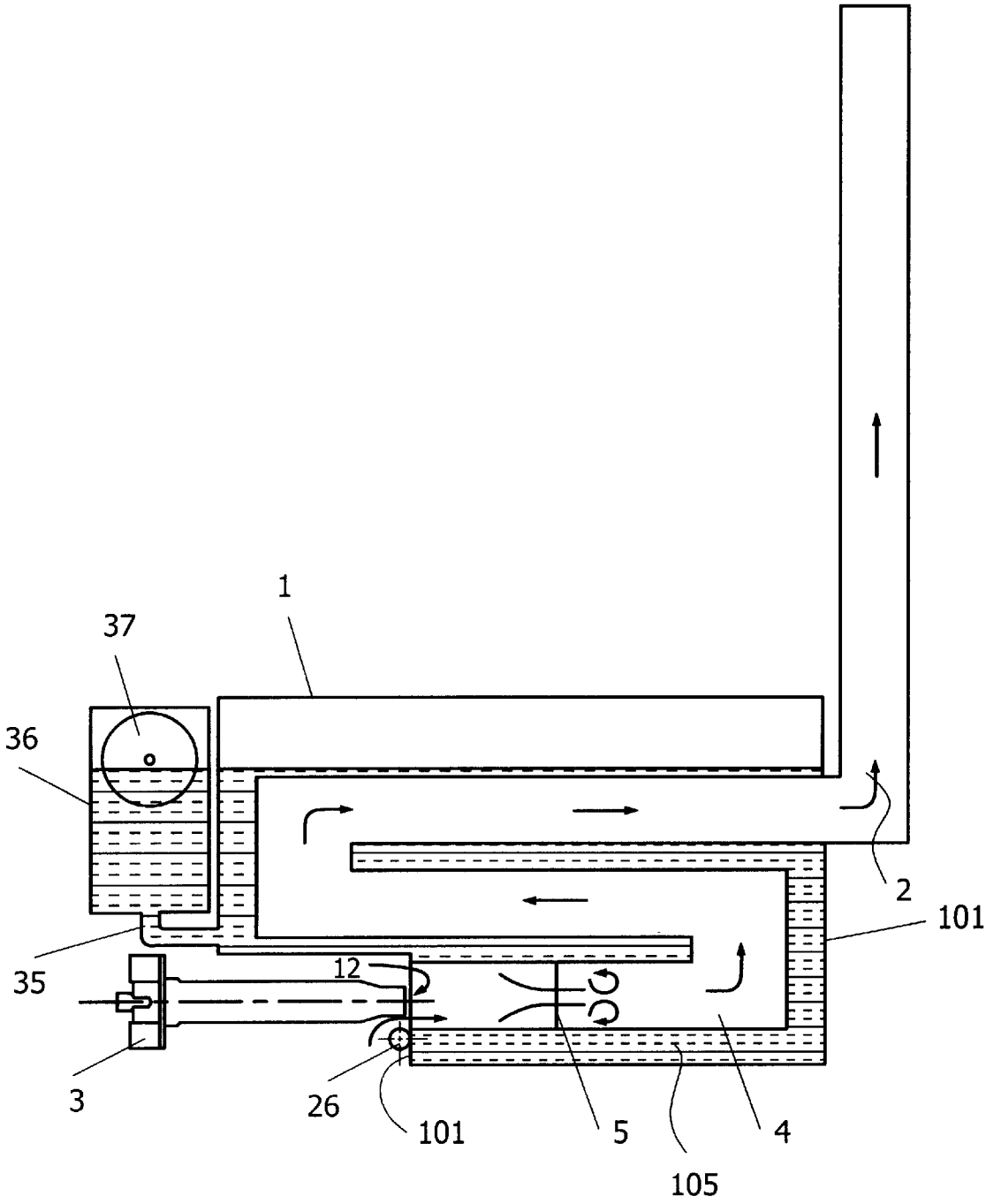
FIG. 1 is a cross-sectional view of the water vessel of the present invention in combination with a gas burner for illustration.
Figure 2:
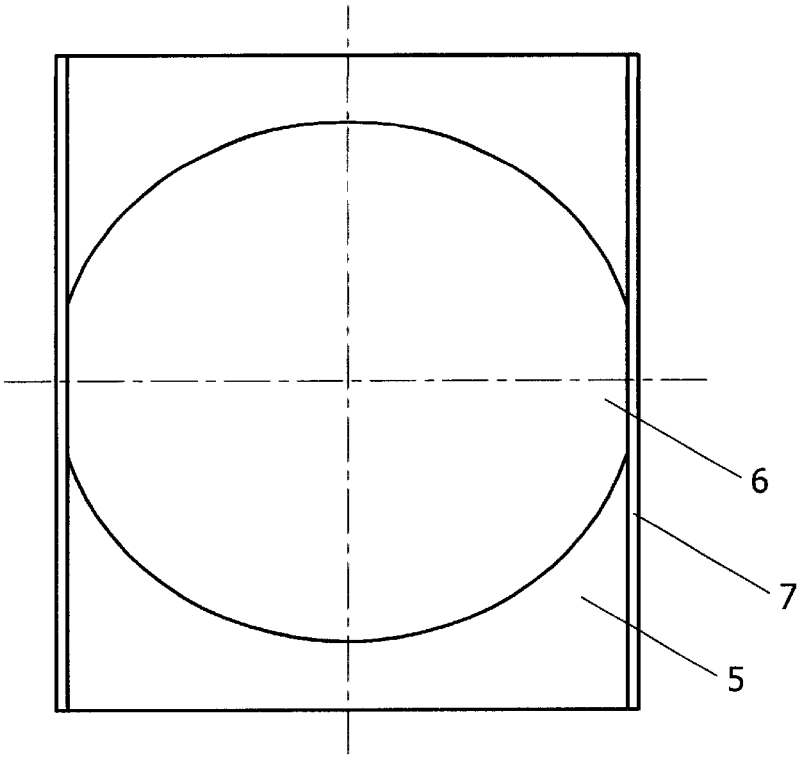
FIG. 2 shows the front view of a turbulent plate for use in combination with the flue pipe of FIG. 1 above.

Referring to FIG. 1, there is shown a cross-sectional view of a preferred embodiment of a water vessel (1) in combination with a gas burner (3) which is shown for illustration only. The water vessel (1) includes a water container having a solid peripheral wall (101) made preferably of a solid material such as stainless steel or other metal alloys. To minimise undesirable heat dissipation from the outside of the peripheral wall to the atmosphere, the outside of the peripheral housing is preferably thermally insulated for better preservation of energy and therefore more environmentally friendly.

Referring to the cross-sectional view of the water vessel (1), the water vessel is formed with a flue pipe (4) extending from one side of the peripheral housing to a position adjacent the other side. The flue pipe is preferably made of a good thermal conductive material such as stainless steel, aluminum or copper alloys or other good thermally conductive materials which are also heat resistant to sustain prolonged high-temperature combustion within the flue pipe. The flue pipe (4) extends between the peripheral housing of the water vessel (1) and its full length is preferably fully submerged in water during normal use. Preferably, the inlet and the outlet of the flue pipe are located at different vertical levels on the peripheral wall of the water vessel (1). Although this embodiment places the inlet and outlet on opposed sides of the housing, other arrangements can place them on the same or adjacent sides of the housing.

To maximise thermal efficiency by maximising the heat transfer between the heat generated in the flue pipe (4) and the surrounding water, the physical length of the flue pipe (4) should be maximised for a given volume of water in the water vessel to the extent that there is sufficient surrounding water to remove the heat generated. To increase the actual physical length of the flue pipe (4), the inlet and the outlet of the flue pipe are located on different horizontal and/or vertical levels on the peripheral housing (101). The flue pipe can make several 180-degree bends before reaching the outlet to form a convoluted pathway through the housing. To ensue efficient thermal transfer from the flue pipe (4) to the surrounding water, a reasonable distance is maintained between adjacent parts of the flue pipe so that sufficient amount of water for heat transfer is available in the space between adjacent flue pipe portions.

Of course, in addition to the "S" shaped bends joining the flue pipe inlet and outlet on different vertical levels, the flue pipe can extend or spread both vertically and horizontally, provided here are sufficient "S", circular or other sharp bends such as 180-degree bend to maximise the length of the flue pipes for good thermal transfer. Of course, it should be borne in mind that the length of the flue pipe should be optimised so that a reasonable amount of water available for hot steam generating is always maintained for contact with the flue pipe after a certain period of operation. It the present preferred embodiment, the flue inlet is retracted from the outer edge of the peripheral wall so that the nozzle (12) of a main gas burner (3) is totally located beneath the bottom of the water vessel (1). Thus, the water vessel (1) of FIG. 1 contains a stepped portion at the left side bottom to ensure most heat is used for heating water. To direct the exhaust gas to move away from the water boiler, a long chimney is connected to the flue pipe outlet and extends substantially vertically away from the water boiler.

In the following specification, it should be appreciated that the term water boiler and the term hot steam generator will be used interchangeably for succinctness and convenience.

Figure 3:
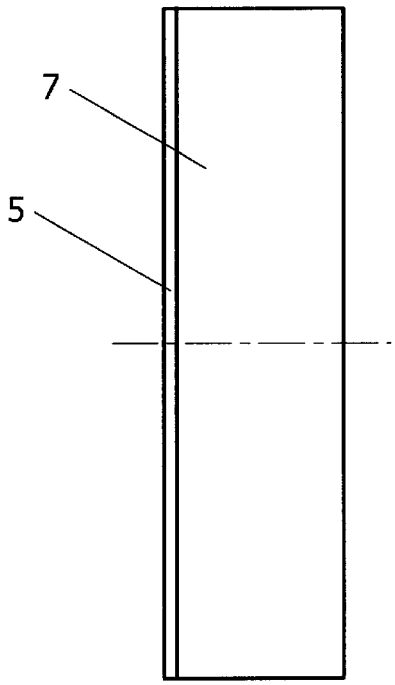
FIG. 3 shows the side view of the turbulent plate of FIG. 2.

Referring to the flue pipe (4) in FIG. 1, there is described a baffle plate (5) which is placed near the flue pipe inlet. The baffle plate (5) includes an aperture (6) which is generally smaller than the aperture of the flue pipe (4). The baffle plate (5) is placed inside the flue pipe and is disposed with its plane substantially perpendicular to the flow of the flue gas from the main gas burner (3). The baffle plate (5) has an opening which abruptly reduces the effective aperture of the flue pipe (4) for a short length and causes turbulence of the gaseous mixture coming from the gas burner (3). The introduction of such a turbulence generator causes improved mixing of the air and fuel gas inside the flue pipe for better combustion efficiency. The side of the baffle plate member (5) as shown in FIG. 3 includes an axially extended collar member for attaching to the inner wall of the flue pipe (4) for fixing its position along the flue pipe (4). Preferably, the flue pipe is provided with corresponding retaining means to keep the baffle member (5) in position against the pressure of the incoming gases.

Referring to the combination of the gas burner and the water vessel as shown in FIG. 1, it will be observed that the elongated gas burner is placed adjacent to the flue pipe inlet. When pressurised fuel gas is injected from the nozzle of the gas burner (3) into the flue pipe (4), air for supporting combustion will be drawn into the flue pipe (4) as a result of the fuel gas movement which generates a low pressure zone within the flue pipe (4). This suction of external ambient air provides secondary and additional air for combustion within the flue pipe when the primary source of air is already mixed within the main gas burner (3) to be explained below. For convenient ignition, a pilot flue (26) is located slightly below the outlet nozzle of the main gas burner so that the fuel gas from the main gas burner (3) can be ignited easily and remotely. In FIG. 1, it will be observed that the axis of the elongated gas burner (3) is substantially aligned with that of the initial (beginning) portion of the flue pipe so that the flame can easily spread through the flue pipe.

Figure 4:
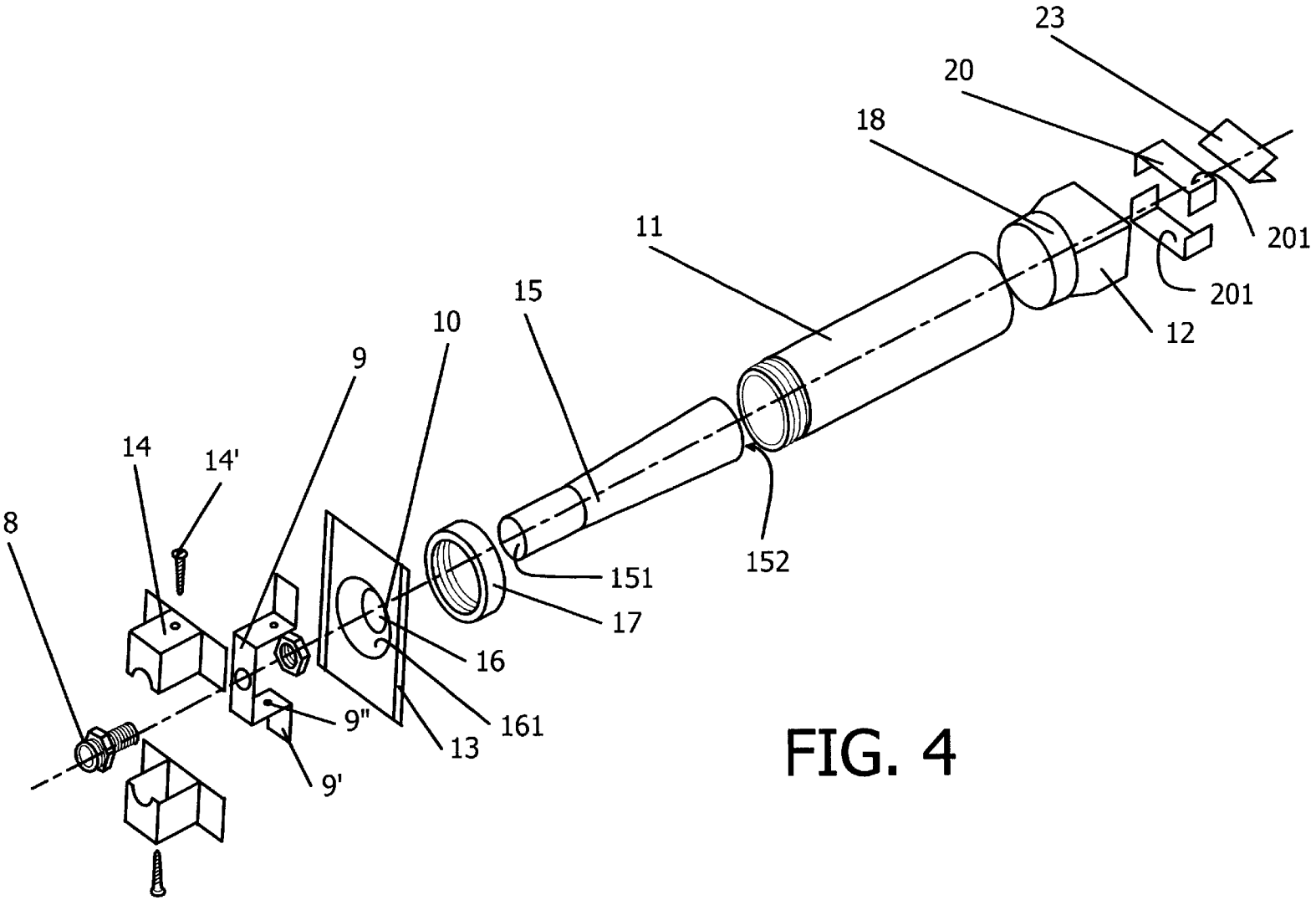
FIG. 4 is the exploded view of a preferred main gas burner.
Figure 5:
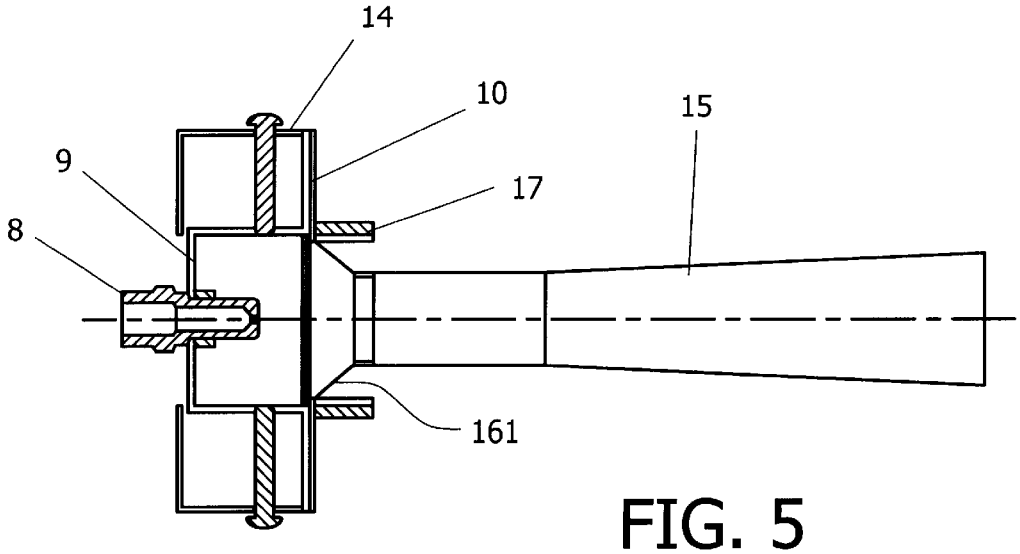
FIG. 5 is a longitudinal sectional view of the front part of the main gas burner of FIG. 1.

Referring now to FIG. 4, there is provided a more detailed description of the main gas burner (3) as shown in the preferred embodiment of FIG. 1. The main gas burner (3) includes an inlet portion, a guide portion and an outlet portion. The inlet portion includes a tubular inlet member (8) having external thread along its outer periphery. The tubular portion (8) is mounted onto an air-inlet gate (10) via a supporting structure which, in the present embodiment, is a U-shaped mount (9) with an aperture (16) at its centre portion for receiving the tubular gas inlet member (8). The air-inlet gate (10) is a substantially plan member having an aperture (16) the centre of which it is substantially aligned with the centre of the tubular gas inlet (8). At the surface of the inlet gate, which is away from the gas inlet, a collar member (161) which is generally an axially extending perimeter member is formed for coupling wit the guide portion of the burner (3). The aperture (16) on the air-inlet gate (10) provides a venue for primary mixing of the fuel gas and the ambient air as the aperture on the air-inlet gate (16) is significantly larger than the cross-section of the gas inlet member (8).

To adjust the volume of air entering the aperture (16), there is provided a pair of slidable members (14) having a substantial planer surface together with a partial aperture. An adjustable aperture is formed between the slidable members by adjusting the separation between the planar surfaces of the members. The slidable members (14) are retained on the air-inlet gate (10) by a pair of grooves or slots formed along the sides of the inlet gate (1) to allow relative sliding of the slidable members (14). The slidable members are also mounted on the U-shaped member (9) by screws or other suitable fastening means. The aperture size can be adjusted by turning the screws to move the slidable members towards or away from each other.

The front end of the inlet portion, namely, the collar member (161) on the air-inlet gate, is connected, for example, by welding or other joining means, to a tubular gas-guide member (15). The gas-guide member (15) has an inlet (151) for receiving the air-gas mixture from the inlet portion and an outlet (152) for delivering the gas mixture towards the burner outlet (12). The guide member (15) includes a substantially cylindrical tubular member which is joint to a frustro-conical shaped tubular member so that the internal aperture of the gas-guide member (15) gradually increases from the inlet (151) to the outlet (152). A gas-guide member with such a design resembles a Venturi tube which provides further mixing of the gases components and, hopefully, improves combustion of the gaseous mixture further. A ring member (17) having screwed threads formed along the inner circumference of the ring (17) is also welded to the air-inlet gate adjacent to the collar member (161). This screw-threaded ring member (17) is provided for removable connection of another tubular member (11) which surrounds the Venturi tube member (15) and for connection with the flame-head (12). The front end of the tubular member is connected to the flame-head (12) of the main gas burner (3) which is shown in FIG. 6.

Figure 6:
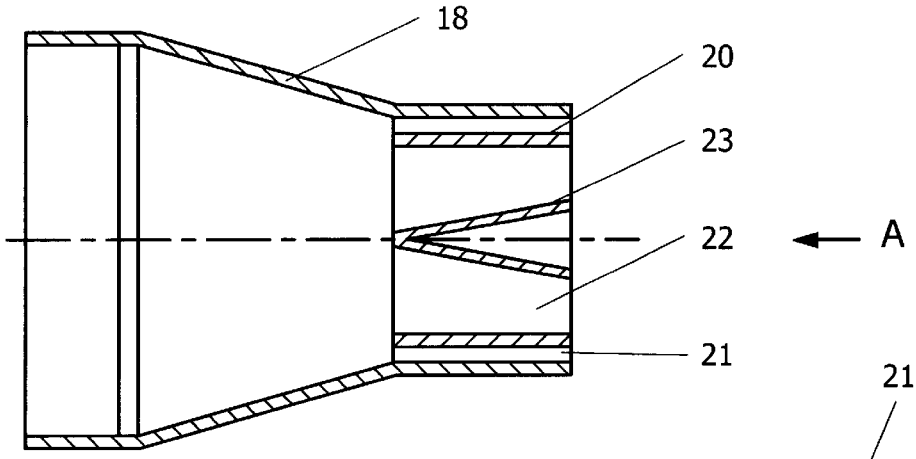
FIG. 6 is a longitudinal cross-sectional view of the front portion of the main gas burner.
Figure 7:
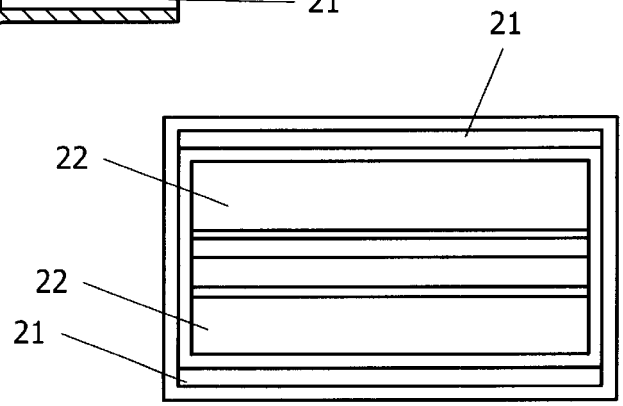
FIG. 7 is front view of the front part of FIG. 6 when viewed from the direction A.

Referring now to FIGS. 4 to 7, the head portion of the main gas burner (3) includes a hollow member which forms a transitional coupling between the cylindrical end of the tubular member (11) and a substantially rectangular flame outlet at the front of the head portion. To adjust the aperture of the primary flame outlet 22, there are provided a pair of moveable plate members each of which extends substantially longitudinally along the rectangular outlet so that the size of the initially generated flame can be adjusted by setting the distance between the bridging portion (201) of the two slidable members. In addition, a V-shaped panel member is also disposed longitudinally within the flame outlet in the manner as shown in FIG. 6 so that, by tilting the vertex of the V-shaped member, the initial direction of the flame exiting from the flame outlet can be adjusted. Stated simply, the size of the flame as well as the initial direction of the blowing flame is controlled by the combination of the pair of moveable members as well as the V-shaped panel. The head portion and the parts therein are preferably made of stainless steel for better heat and corrosion resistance as well as being relatively light.

Referring to FIG. 6, as a result of the moving together of the two moveable members, secondary flame outlets (21) are also formed near the top and bottom edges of the flame outlet. Incidentally, the apertures of these secondary flame outlets (21) are smaller than the main flame outlets (22) and has a flame stabilisation effect. With the afore-said structure of the head portion, the main gas burner can adapt to different kinds of fuel gases as well as providing different levels of flame intensity.

Figure 8:
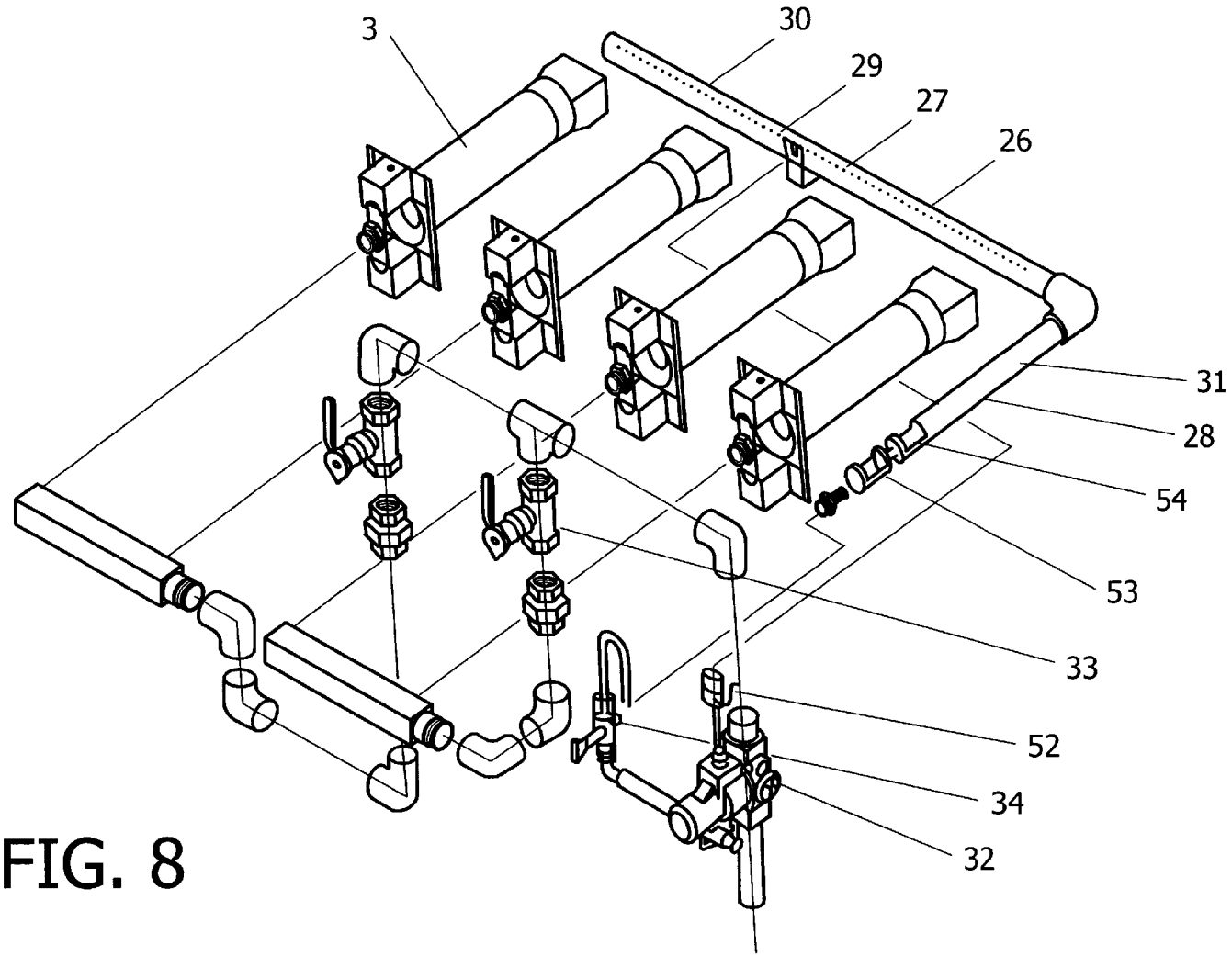
FIG. 8 shows the gas circuit connection of an assembly of main gas burners.

Referring to FIG. 8, there is shown an assembly comprising four main gas burners (3) in parallel. The main gas burner (3) in the assembly of gas burners can be selectively ignited in different combination so that different modes and intensity of flame heating can be provided. For completeness, a main gas switch (33) for controlling the supply of fuel gas to the main gas burner is also shown.

As shown in FIGS. 1 and 8, there are provided a plurality of pilot flame burners (26) which are distributed along a length of pilot gas distributing duct (30) with inlet portion (28) and a plurality of tiny gas outlet (29) along the gas duct (30). The pilot gas inlet portion (28) includes an inlet tubular portion having one end connected to the pilot gas duct (30) and another end having an air inlet (54) and an collar member (53) for adjusting the aperture of the air inlet (54). An electro-magnetic safety switch (32) is installed at the main gas entry to the assembly. External fuel gas is supplied to the main gas pipe via safety switch (32) and then to the main duct for connection to the plurality of main gas burners (3). The main gas duct also provides branch connections to supply gas to the pilot gas duct (30). A safety sensor is positioned near the burner part (27) and the sensing signal is sent to the main switch (32) by wire connection. The pilot flame burner (26) is a simple duct atmospheric burner with a single array of apertures for providing continuous but small flames to ensure consistent and reliable ignition. A safety switch (34) is provided so that gas supply to the individual pilot flame burner can be cut off when no combustion is detected to prevent gas leakage. In the Figure, there are also shown a gas switch (33) for the main gas burners and switch (34) for the pilot gas burners. The height of the chimney (2) is designed according to established principle to ensure sufficient suction is provided to the flue pipe in order to provide sufficient suction for incoming fresh air as well as removing the exhaust gas. Furthermore, where a common chimney is used for the assembly of main gas burners, partitions can be formed within the chimney so that cold air from the chimney of the unused gas burners will not enter the hot chimney and reduces thermal efficiency.

As can be seen from FIG. 1, gas combustion for heat generation occurs almost entirely within the flue pipe which effectively forms a distributed gas combustion chamber inside the water vessel. Since the distributed combustion chamber (flue pipe) is preferably fully submerged within the water to be heated, a very high thermal efficiency can be obtained as nearly all the heat generated is transferred to the surrounding water. The design of the distributed gas combustion chamber coupled with the use of the turbulent plate which causes return flow of the unburned gases, thereby improving combustion as well as reducing nitrogen oxides from he exhausted gas. It should be noted that the housing also allows water to reside below the gas burner along the base in region 105 in FIG. 1. Although water below the burner receives less heat, this volume of water does receive some heating while acting to insulate the base of the housing. Conventional devices tend to sit on insulating platforms that may draw heat themselves leading to less efficiency. Also the present arrangement ensures the base of the housing does not require extra insulation or fittings as it should not rise above the temperature of the heated water.

Figure 9:
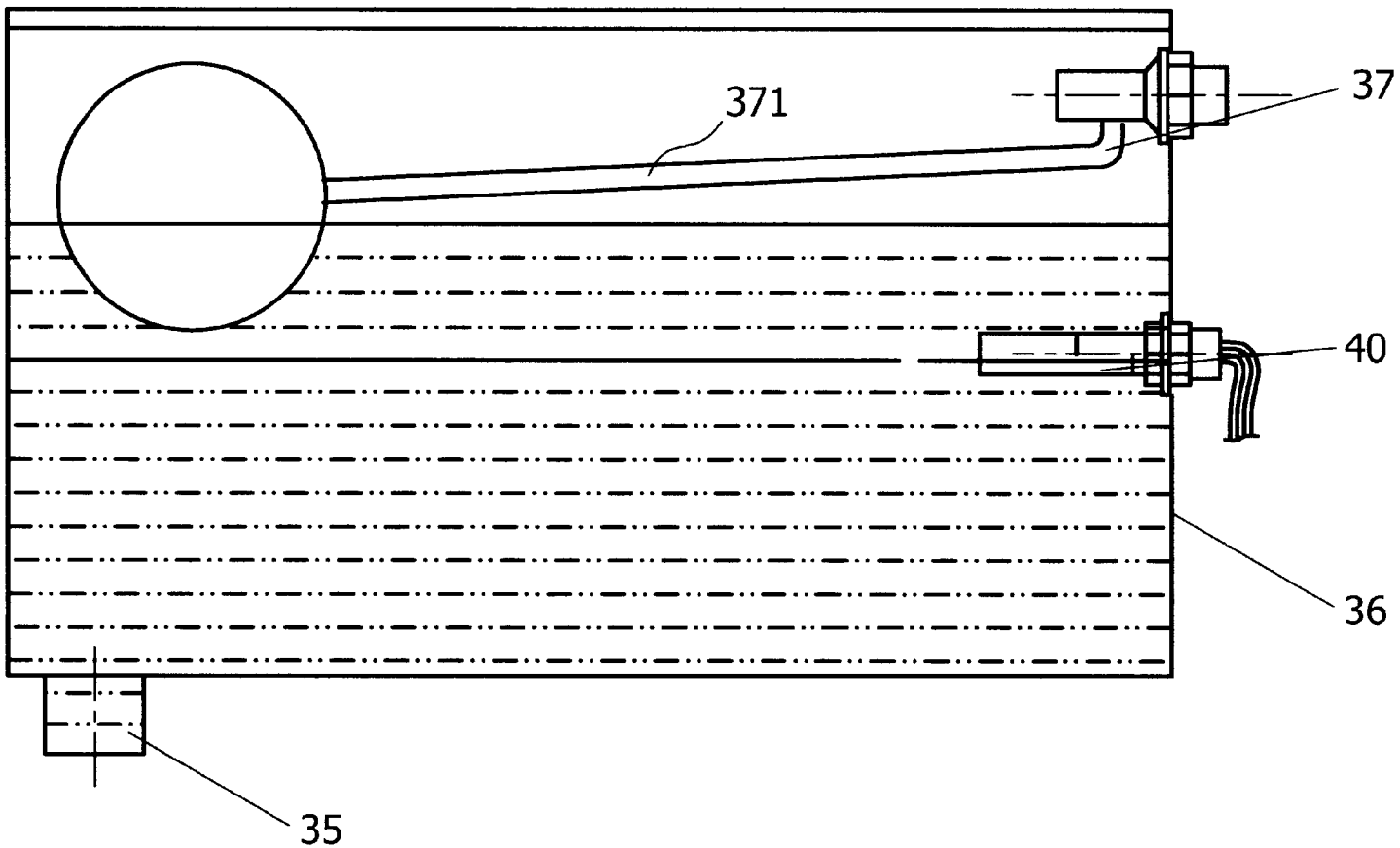
FIG. 9 is a cross-sectional view of the reservoir (36) of FIG. 1.

To further enhance the safety of the hot water boiler, there is shown in FIGS. 1 and 9 a safety device which ensure that gas combustion in the flue pipes will only occur if the water level in the water vessel reaches a certain pre-determined level. To achieve this, there is provided a reservoir which is connected to the water vessel. A floating body (37), for example, a hollow plastic ball, is connected by a lever (371) to a safety switch is arranged so that only when the floating body is elevated to a certain level, the switch (37) will send a signal to the main safety switch (32) and supply gas for combustion. When the floating body descends below a certain pre-determined level, lever (37) will cause the switch to send a stop signal to the main switch to cut off gas supply to the main gas burners. With such an arrangement, the hot steam generator will not start by or will stop burning once the water level is below a pre-determined save operation level.

Figure 10:
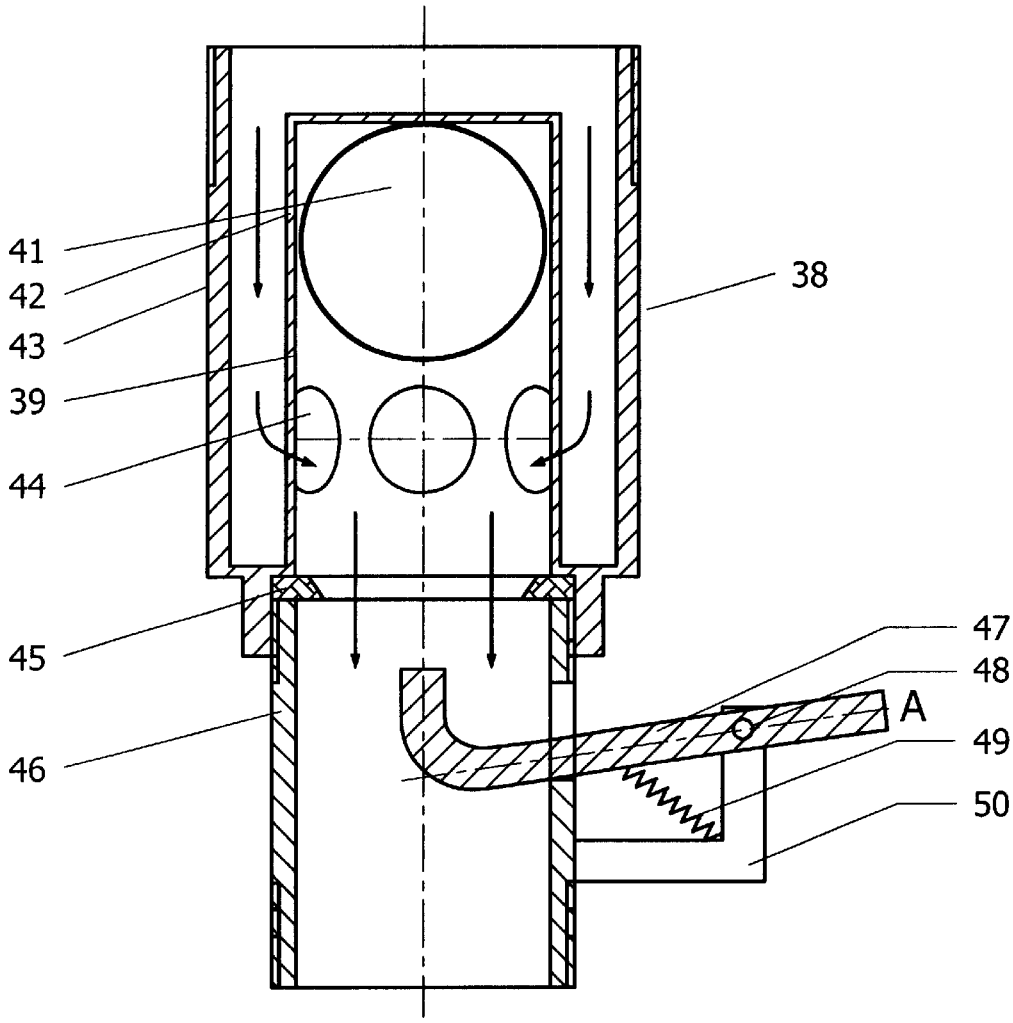
FIG. 10 is a illustrative diagram showing water draining assembly with a floating body valve control system.

Referring to FIG. 10, there is shown a draining valve (38) for connecting to the bottom of the water vessel for draining water stored in the water vessel (1). The draining valve (38) includes a floating body (41), a housing (38) having an external wall (43) and an internal cage (42). The internal cage (42) has a closed top with a plurality of draining holes (44) formed on its lower side. The top of the draining valve is connected to the bottom of the water vessel so that the space formed between the inner cage (42) and the outer wall (43) of the draining valve (38) is communicable with the water vessel (1). A draining pipe (46) is connected to the lower end of the cage (42). There is provided a sealing ring (45) at the transition between the inner cage and the draining pipe (46). The floating body (41) is trapped within the inner cage (39) of the housing (42) and sits on the sealing ring (45) for blocking the draining hole (44) to prevent undesirable water leakage. A draining lever (47) which is positioned beneath the sealing ring (45) and has one upward bend which points towards the floating body (41). The other end of the level (47) extends beyond the draining pipe (46) for linking with the pilot flame switch (34). The lever (47) is pivotally mounted on a support device mounted external to the draining pipe with one end of the support means being formed on the outside of draining pipe. There is further provided a spring which joins the support means and the lever (47). When the hot water boiler is put out of operation, the pilot flame switch (34) is turned off and the lever (47) will be triggered by the linkage to produce an instantaneous upward movement at the bend end of the lever. The bend then pushes the floating body (41) upwards and water from the water vessel (1) will drain through the draining aperture (44) (through the inner cage (42) to the draining pipe). At this time, the floating body (41) will be floated until stopped by the top of the inner cage. As the lever (47) is under spring (49) bias, it returns to its previous position and draining will continue. When water has been fully drained, the floating body loses buoyancy and returns by gravity to the position at which it sits on the sealing ring (45) and seals the draining hole. Since the water draining rate can be designed to largely exceed the filling rate, there is no need to shut off water supply during draining. After the floating body has been restored to its previous position, water will be refilled for the next steam or hot water generation. In this process, the floating body (41) is balanced between gravity and floatation and undesirable leakage can be prevented.

Figure 11:
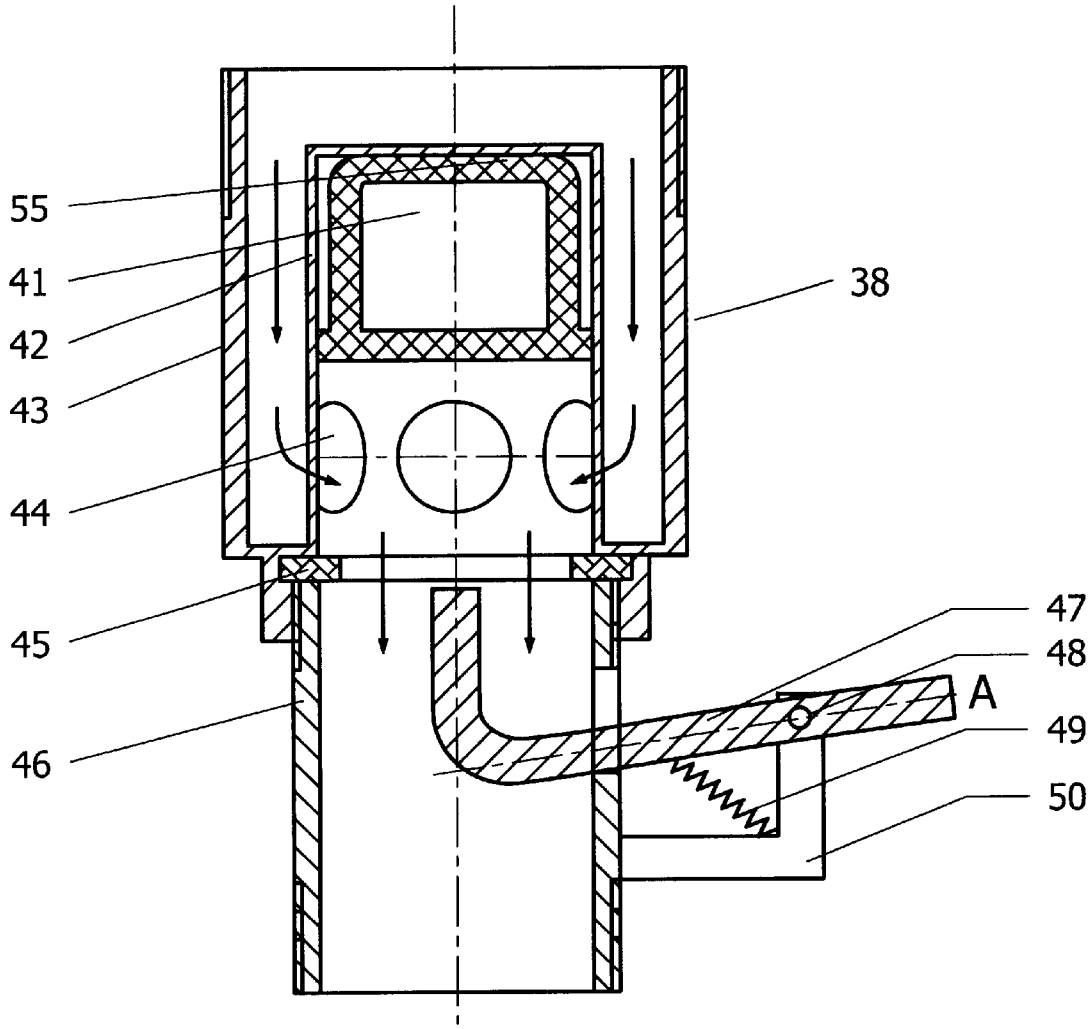
FIG. 11 shows a second embodiment of a floating body suitable for use in the draining assembly.

FIG. 11 shows an alternative design of a floating body (41) in which it is a cylindrical body instead of a spherical body. Also, the inner cage is provided with an open top case with the top aperture smaller than the cross-sectional dimension of the floating body. While the present invention has been explained with reference to the specific embodiments described, it should be understood that there specific embodiments are only provided for illustrating the general concept of the invention and should not be construed in any limiting sense. In summery, the scope and spirit of the present invention includes trivial or non-trivial modifications of the above embodiments which are reasonably foreseeable by a person skilled in the art.

What is claimed is:

1. A water boiler or hot steam generating apparatus including a gas burner and a water vessel having a peripheral wall, said water vessel including a combustible gas inlet and an exhaust gas outlet disposed on said peripheral wall of said water vessel, said gas inlet and said gas outlet being interconnected by a flue pipe which is adapted to be fully submerged in the water inside the water vessel during normal operation, wherein combustion of the gas originating from said gas burner occurs almost entirely within said flue pipe and combustion occurs substantially along the length of said flue pipe, and a planar member disposed in said flue pipe substantially perpendicular to the longitudinal direction of said flue pipe at a short distance from said gas inlet, said planar member having an aperture smaller than the general aperture of said flue pipe for abruptly changing the aperture of said flue pipe for a short length.

2. An apparatus according to claim 1, wherein the gas outlet of said gas burner is placed adjacent to the gas inlet of said flue pipe so that almost all of the flame of gas combustion from the gas burner is enclosed within said flue pipe.

3. An apparatus according to claim 1, wherein the path of said flue pipe is convoluted.

4. An apparatus according to claim 1, wherein said flue pipe includes at least an obtuse bend.

5. An apparatus according to claim 1, wherein said flue pipe includes a plurality of substantially 180-degree bends or adjacent 90-degree bends.

6. An apparatus according to claim 1, wherein the periphery of said flue pipe is surrounded by water in the water vessel during normal operations.

7. An apparatus according to claim 1, wherein said gas burner includes an elongated portion connected to the gas outlet of said gas burner, wherein the longitudinal of said elongated portion is substantially aligned with the axis of the initial length of said flue pipe.

8. An apparatus according to claim 1, wherein said gas burner includes an elongated portion near the outlet of said gas burner, wherein said elongated portion includes a gradually increasing cross-section towards said gas outlet.

9. A water boiler or hot steam generating apparatus including a gas burner and a water vessel having a peripheral wall, said water vessel including a combustible gas inlet and an exhaust gas outlet disposed on said peripheral wall of said water vessel, said gas inlet and said gas outlet being interconnected by a flue pipe which is adapted to be fully submerged in the water inside the water vessel during normal operation, wherein combustion of the gas originating from said gas burner occurs almost entirely within said flue pipe and combustion occurs substantially along the length of said flue pipe, and wherein said gas burner includes a flame outlet having an aperture which is partitioned into 3 parts, the relative area of said 3 parts being adjustable to provide a main flame outlet and secondary flame outlets.

10. An apparatus according to claim 9, wherein a flame guide for adjusting the initial angular direction of the flame leaving the burner is provided within said flame outlet.

11. A water vessel for water boiling or hot steam generation including a peripheral wall, said water vessel including a combustible gas inlet and an exhaust gas outlet disposed on said peripheral wall of said water vessel, said gas inlet and said gas outlet being interconnected by a flue pipe which is adapted to be fully submerged in the water inside the water vessel during normal operation, wherein a portion of the flue pipe adjacent to the gas inlet is elevated from the bottom of said water vessel so that, during operation, the space between that portion of said flue pipe and the bottom of said water vessel is filled with water, and a gas burner including a flame outlet having an aperture which is partitioned into 3 parts, the relative area of said 3 parts being adjustable to provide a main flame outlet and secondary flame outlets.

12. A water vessel according to claim 11, wherein said combustible gas inlet of said flue pipe is retracted from the outmost edge of said peripheral wall.

13. A water vessel according to claim 11, wherein the path of said flue pipe is convoluted.

14. A water vessel according to claim 11, wherein said flue pipe includes at least an obtuse bend.

15. A water vessel according to claim 11, wherein said flue pipe includes a plurality of substantially 180-degree bends or adjacent 90-degree bends.

* * * * *